US007052108B2

(12) United States Patent
West et al.

(10) Patent No.: US 7,052,108 B2
(45) **Date of Patent: *May 30, 2006**

(54) PURGE SHUTDOWN FOR A SOLVENT INK PRINTING SYSTEM

(75) Inventors: Kenneth J. West, Dayton, OH (US); Meagan A. Wimmers, Springboro, OH (US); Jay D. Frazier, Jamestown, OH (US); David A. Huliba, Centerville, OH (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/011,842

(22) Filed: Dec. 14, 2004

(65) Prior Publication Data

US 2005/0093916 A1 May 5, 2005

Related U.S. Application Data

(63) Continuation of application No. 10/264,751, filed on Oct. 4, 2002, now Pat. No. 6,869,160.

(51) Int. Cl.
*B41J 2/165* (2006.01)

(52) U.S. Cl. ..... 347/28

(58) Field of Classification Search ..... 347/22, 347/24, 28, 23, 76, 77, 90; 134/22.11
See application file for complete search history.

(56) References Cited

U.S. PATENT DOCUMENTS

| | | | |
|---|---|---|---|
| 3,836,913 A | 9/1974 | Burnett et al. | |
| 4,928,114 A | 5/1990 | Fagerquist et al. | |
| 5,237,341 A | 8/1993 | Iwagami et al. | |
| 6,145,954 A | 11/2000 | Moore | |
| 6,196,657 B1 | 3/2001 | Hawkins et al. | |
| 6,254,216 B1 | 7/2001 | Arway et al. | |
| 6,273,103 B1 | 8/2001 | Enz et al. | |
| 6,398,351 B1 | 6/2002 | Blum et al. | |
| 6,869,160 B1 * | 3/2005 | West et al. | 347/28 |

FOREIGN PATENT DOCUMENTS

| | | |
|---|---|---|
| EP | 0424008 | 4/1991 |
| EP | 0561406 | 9/1993 |

(Continued)

OTHER PUBLICATIONS

Janeway III D L: "Selective Ink-Jet Assembly Cleaning" IBM Technical Disclosure Bulletin, IBM Corp. New York, US, vol. 23, No. 1, Jun. 1, 1980, pp. 93-95.

*Primary Examiner*—Shih-Wen Hsieh
(74) *Attorney, Agent, or Firm*—William R. Zimmerli

(57) ABSTRACT

A shutdown procedure is provided for removing all solvent ink from the printhead of an ink jet printer system that uses volatile ink for printing a shutdown method is provided for an inkjet printer that uses volatile inks for printing. Initially, a colorless flush fluid is provided which readily dissolves the ink. The flush fluid is crossflushed through the drop generator and caused to weep out of the orifices in the drop generator to dissolve and rinse away ink residues from the charge plate and the exterior of the orifice plate. The flush fluid is used to rinse off charging electrodes of the charge plate, the catcher face, and the catcher return line. Fluid crossflushed through the drop generator cleans the interior of the drop generator and cleans the crossflush valve.

4 Claims, 3 Drawing Sheets

FOREIGN PATENT DOCUMENTS

| | | |
|---|---|---|
| EP | 0908316 A1 | 4/1999 |
| EP | 1013437 | 6/2000 |
| GB | 2236712 A | 4/1991 |
| GB | 2316364 | 2/1998 |

* cited by examiner

100

FIG. 2

SOLVENT INK SHUTDOWN STATE TABLE

| STATE # | INK SERVO PRESSURE | CLEANER SERVO PRESSURE | VACUUM SERVO | STIM VOLTAGE | CHARGER VOLTAGE | CATCHER HEATER | CONDENSATION HEATER | EYELID HEATER | EYELID | STATE TIME | INK SUPPLY VALVE | FLUSH FLUID VALVE | AIR INGEST | CROSSFLUSH VALVE | CATCHER VALVE | WASTE VALVE | DIVERTER VALVE | STATE DESCRIPTION |
|---|---|---|---|---|---|---|---|---|---|---|---|---|---|---|---|---|---|---|
| UNITS | PSI | PSI | "Hg | | | | | | OPEN/CLOSED | SECONDS | OPEN/CLOSED | OPEN/CLOSED | OPEN/CLOSED | OPEN/CLOSED | OPEN/CLOSED | OPEN/CLOSED | OPEN/CLOSED | |
| | 50 | 24 | 68 | | | | | | 62 | | 64 | 30 | 66 | 32 | 46 | 36 | 38 | FIG. 1 ENTITY |
| PRINT READY | 7.5 | | 15 | ON | ON | ON | OFF | ON | OP | | OP | CL | CL | CL | OP | CL | OP | |
| 0 | 0 | 0 | 9 | OFF | OFF | OFF | OFF | OFF | CL | 15 | OP | CL | CL | OP | OP | CL | OP | STIM & PUMPS OFF, VAC ON, CROSSFLUSH VALVE OPEN |
| 1 | 0 | 0 | 9 | OFF | OFF | OFF | OFF | OFF | CL | 5 | CL | CL | CL | OP | OP | CL | OP | CLOSE ANTI SIPHON VALVE |
| 2 | 0 | 0 | 0.4 | OFF | OFF | OFF | OFF | OFF | CL | 1 | CL | CL | CL | CL | OP | CL | OP | CLOSE CROSSFLUSH VALVE REDUCE VACUUM |
| 3 | 0 | 0 | 15 | OFF | OFF | OFF | OFF | OFF | CL | 2 | CL | CL | CL | CL | OP | CL | OP | INCREASE VACUUM |
| 4 | 0 | 0 | 15 | OFF | OFF | OFF | OFF | OFF | CL | 0.5 | CL | CL | CL | OP | OP | CL | OP | OPEN CROSSFLUSH VALVE |
| 5 | 0 | 0.5 | 15 | OFF | OFF | OFF | OFF | OFF | CL | 0.5 | CL | OP | CL | OP | OP | CL | OP | WEEPING CROSSFLUSH AT 0.5PSI (CLEANER) |
| 6 | 0 | 0.5 | 15 | OFF | OFF | OFF | OFF | OFF | CL | 0.5 | CL | OP | CL | OP | OP | OP | OP | WEEPING CROSSFLUSH AT 0.5PSI (CLEANER) |
| 7 | 0 | 0.5 | 15 | OFF | OFF | OFF | OFF | OFF | CL | 30 | CL | OP | CL | OP | OP | OP | CL | WEEPING CROSSFLUSH AT 0.5PSI (CLEANER) |
| 8 | 0 | 5 | 15 | OFF | OFF | OFF | OFF | OFF | CL | 20 | CL | OP | CL | CL | OP | OP | CL | JETTING AT 5.0PSI (CLEANER) |
| 9 | 0 | 0.5 | 15 | OFF | OFF | OFF | OFF | OFF | CL | 30 | CL | OP | CL | OP | OP | OP | CL | WEEPING CROSSFLUSH AT 0.5PSI (CLEANER) |
| 10 | 0 | 0.5 | 18 | OFF | OFF | OFF | OFF | OFF | CL | 0.5 | CL | OP | CL | OP | OP | OP | CL | INCREASE VACCUM |
| 11 | 0 | 0 | 18 | OFF | OFF | OFF | OFF | OFF | CL | 60 | CL | CL | CL | CL | OP | OP | CL | CLOSE CLEANER VALVE AND CROSSFLUSH VALVE |
| 12 | 0 | 0 | 18 | OFF | OFF | OFF | OFF | OFF | CL | 120 | CL | CL | OP | OP | CL | OP | CL | CLOSE CATCHER VALVE AND OPEN CROSSFLUSH VALVE |
| 13 | 0 | 0.5 | 18 | OFF | OFF | OFF | OFF | OFF | CL | 30 | CL | OP | CL | OP | OP | OP | CL | WEEPING CROSSFLUSH AT 0.5 PSI |
| 14 | 0 | 0 | 18 | OFF | OFF | OFF | OFF | OFF | CL | 60 | CL | CL | OP | OP | OP | OP | CL | CLOSE CLEANER VALVE AND OPEN CROSSFLUSH VALVE |
| 15 | 0 | 0 | 18 | OFF | OFF | OFF | OFF | OFF | CL | 120 | CL | CL | OP | OP | CL | OP | CL | CLOSE CATCHER VALVE, OPEN AIR INGEST |
| 16 | 0 | 0 | 18 | OFF | OFF | OFF | OFF | OFF | CL | 1 | CL | CL | OP | CL | CL | OP | CL | CLOSE CROSSFLUSH VALVE |
| 17 | 0 | 0 | 18 | OFF | OFF | OFF | OFF | OFF | CL | 60 | CL | CL | OP | OP | CL | OP | CL | OPEN CROSSFLUSH VALVE |
| 18 | 0 | 0 | 18 | OFF | OFF | OFF | OFF | OFF | CL | 0.1 | CL | CL | OP | OP | CL | OP | CL | CLOSE CROSSFLUSH VALVE |
| 19 | 0 | 0 | 18 | OFF | OFF | OFF | OFF | OFF | CL | 60 | CL | CL | OP | OP | CL | OP | CL | OPEN CROSSFLUSH VALVE |
| 20 | 0 | 0 | 18 | OFF | OFF | OFF | OFF | OFF | CL | 60 | CL | CL | CL | CL | OP. | OP | CL | OPEN CATCHER VALVE AND CLOSE CROSSFLUSH VALVE |
| 21 | 0 | 0 | 0 | OFF | OFF | OFF | OFF | OFF | CL | 0.5 | CL | CL | CL | CL | OP | CL | OP | SHUTDOWN SYSTEM |

PURGE SHUTDOWN FOR A SOLVENT INK PRINTING SYSTEM

CROSS REFERENCE TO RELATED APPLICATION

This application is a continuation of U.S. patent application Ser. No. 10/264,751, filed Oct. 4, 2002, now U.S. Pat. No. 6,869,160.

TECHNICAL FIELD

The present invention relates to solvent ink printing systems and, more particularly, to a shutdown procedure for a continuous ink jet printhead operating with solvent ink.

BACKGROUND ART

Ink jet printing systems are known in which a printhead defines one or more rows of orifices which receive an electrically conductive recording fluid from a pressurized fluid supply manifold and eject the fluid in rows of parallel streams. Printers using such printheads accomplish graphic reproduction by selectively charging and deflecting the drops in each of the streams and depositing at least some of the drops on a print receiving medium, while others of the drops strike a drop catcher device.

Over the years, a number of inkjet printers using binary array continuous inkjet printing have been developed, with continuing improvements in speed, reliability, and ease of use. These printers are used in a variety of print applications, often using aqueous inks. Using aqueous ink, these printers can print for hours and have demonstrated highly reliable shutdown and subsequent startups without operator intervention. In spite of advances in aqueous ink technology, solvent inks, such as ethanol or MEK based inks, are preferred for some applications. For example, in applications such as printing on metals or plastics, solvent inks are preferred over aqueous inks as a result of the solvent ink characteristics of being much faster drying and more permanent than aqueous inks.

The same characteristics that make solvent inks preferred for printing on metals and plastics, however, make solvent inks much harder to run in inkjet printers. Just as the inks dry quickly on the print media, they also dry quickly on the various components in an inkjet printhead and fluid system. In particular, these inks can dry quickly on the orifice plate and the charge plate in the printhead. On the orifice plate, the dried ink can plug the orifices through which the ink is to be jetted, adversely interfering with jet directionality. When dried on the charge plate, the dried ink can produce shorting conditions between charging electrodes.

As a result of these problems, prior art inkjet printers using solvent inks have required significant intervention by highly trained operators, for proper operation both when the printers are started and shutdown. There is a need for a printer for use with highly volatile solvent based inks which can be shut down in a manner that will allow subsequent reliable start up.

SUMMARY OF THE INVENTION

This need is met by the shutdown procedure according to the present invention, wherein all solvent ink residue and fluid is removed from the printhead. In accordance with the present invention, the catcher face, eyelid seal, catcher line, and bar-out line are all flushed. When compared to existing fluid systems, the purge shutdown procedure of the present invention includes the addition of a separate line to the printhead and an additional valve at the printhead to deliver replenisher fluid directly to the printhead to act as a cleaning fluid.

In accordance with one aspect of the present invention, a shutdown method is provided for an inkjet printer that uses volatile inks for printing. Initially, a colorless flush fluid is provided which readily dissolves the ink. The flush fluid is crossflushed through the drop generator and caused to weep out of the orifices in the drop generator to dissolve and rinse away ink residues from the charge plate and the exterior of the orifice plate. The flush fluid is used to rinse off charging electrodes of the charge plate, the catcher face, and the catcher return line. Fluid crossflushed through the drop generator cleans the interior of the drop generator and cleans the crossflush valve.

Other objects and advantages of the invention will be apparent from the following description, the accompanying drawings and the appended claims.

BRIEF DESCRIPTION OF THE DRAWINGS

FIG. 2 is a solvent ink shutdown state table; and

DETAILED DESCRIPTION OF THE PREFERED EMBODIMENTS

Figure 1:
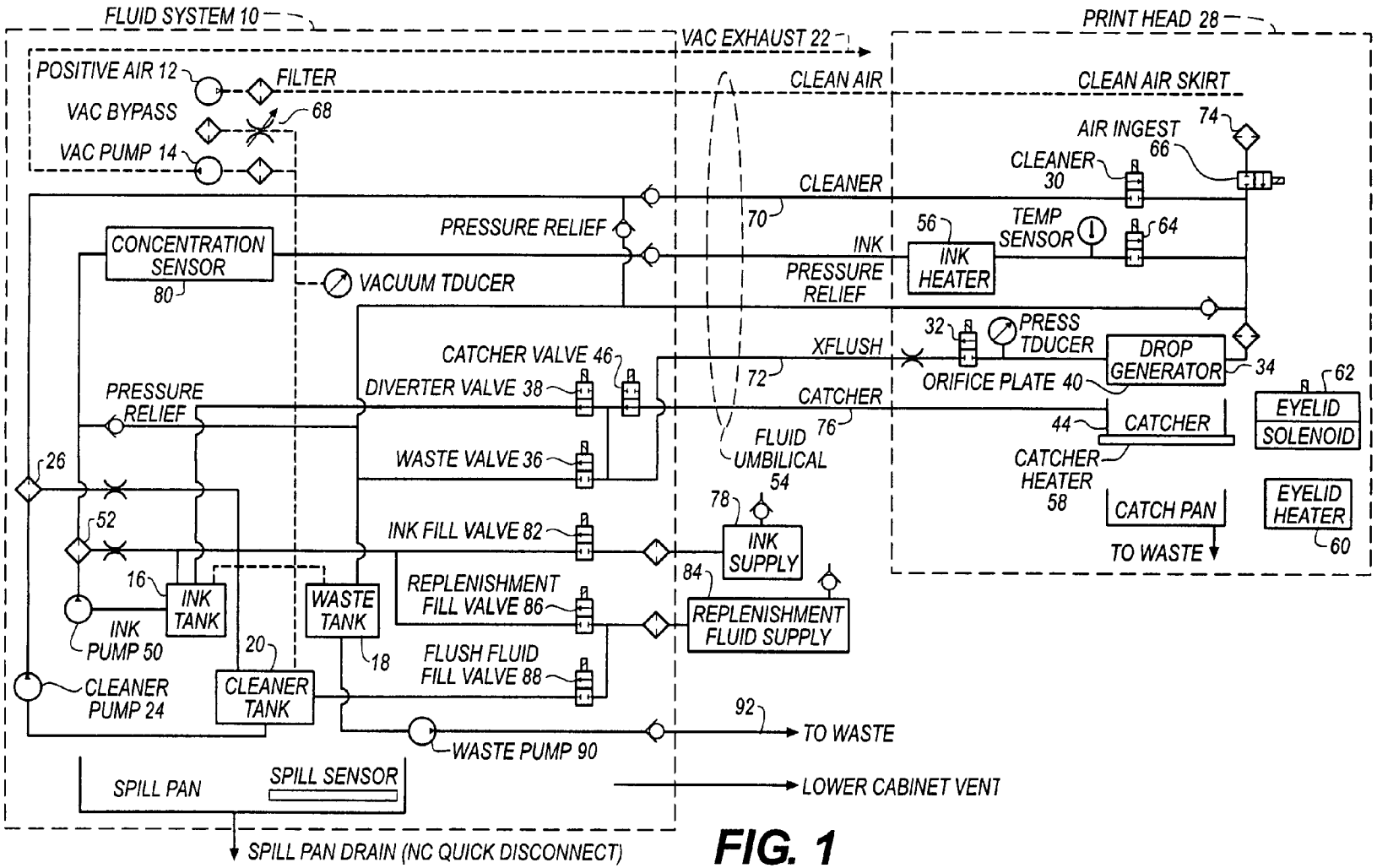
FIG. 1 is a block diagram illustration a fluid system with which the shutdown procedure according to the present invention can be applied.

In accordance with the present invention, the shutdown procedure can be applied to a fluid system configured with one or more printheads. Since the separate inlets and outlets within each printhead interface controller (PIC) and printhead is identical, the following description will make reference only to a single printhead, without restricting the invention to use with a fluid system having only a single printhead.

The present invention allows a printing system to go from a printing state to a down state, and subsequently return to a reliable printing state. Prior to the introduction of the present invention, in printing systems using volatile ink, the catcher and bar-out lines in the printing system would become plugged with dried ink. When the present invention is applied to a volatile ink printing system, reliability for both the printhead and the fluid system can be maintained.

In accordance with the present invention, used flush fluid is directed into a waste fluid tank, and does not cause the ink concentration to be driven downward with each flush cycle. From the waste fluid tank, the used flush fluid can be drained into an external waste tank for disposal. Alternatively, the waste fluid can be used as a replenishment fluid. This embodiment is possible because the flush fluid itself comprises replenishment fluid. Although the used flush fluid will have some ink dissolved in it, the concentration of ink will be quite low. When used as a make up or replenishment fluid for evaporated ink solvent, the used flush fluid will reduce the ink concentration back toward normal but slightly less than if clean replenishment fluid is used. If excessive amounts of used flush fluid are produced, however, it may be necessary to dispose of some of the fluid, as the continual use of used flush fluid instead of clean replenishment fluid will eventually cause the ink concentration to creep upward.

Prior to initiating a shutdown, the printhead will be in a ready-to-print state. This state will be described with reference to the fluid system 10 schematic shown in FIG. 1. In ready to print condition, ink pump 50 is pumping ink out of the ink tank 16, through the filter 52 and up to the printhead 28 via umbilical 54. The ink supply valve 64 is open allowing ink to flow into the drop generator 34. The flush fluid valve 30 and air ingest valve 66 are closed at this time. The crossflush valve 32 is also closed, allowing the ink pressure at the drop generator to rise to the normal operating pressure. At the normal operating pressure, ink is jetted from the orifices of the orifice plate 40 which is attached to the drop generator 34. Piezoelectric actuators (not shown) attached to the drop generator cause the drop generator to vibrate, inducing the ink streams to break off into uniformly sized drops. Charging electrode means are located adjacent to the region where the ink drops break off from the ink streams. Selectively applying a voltage to these charging electrodes allows one to selectively charge the ink drops. The charged drops can then be deflected into catcher means 44, while uncharged drops continue undeflected and strike the print media. The printhead eyelid 62, which is used to seal the printhead when not printing, is now open to allow the print drops to exit the printhead 28. The ink striking the catcher 44 is returned to the ink tank 16 by way of the open catcher valve 46 and diverter valve 38. The return of the fluid to the ink tank is facilitated by vacuum maintained in the ink tank. This vacuum is provided by vacuum pump means 14, which also provides vacuum to flush fluid tanks 20 and waste tank 18. The exhaust from the vacuum pump is directed to an exhaust port 22 on the exterior of the fluid system cabinet. This prevents a buildup of solvent vapors inside the fluid system cabinet. It also provides a convenient means to direct these vapors into fire-safe room exhaust means. Air pump 12 provides a positive pressure in the printhead, reducing the concentration of flammable vapors in the printhead.

The automatic shutdown sequence of the present invention will now be described with reference to FIGS. 1 and 2. In state 0 of the State Table 100 of FIG. 2, the shutdown sequence begins with sequentially closing the eyelid 62, and turning off the charge voltage, stimulation drive signal, and ink pump 50 in FIG. 1. The crossflush valve 32 is also opened. After a predetermined period of time, for example about fifteen seconds, the ink supply valve 64 is closed in state 1. In state 2, the crossflush valve 32 is closed. In state 3, the vacuum servo control system adjusts the restrictor 68 to increase the vacuum in the ink tank 16, flush fluid tank 20, and waste tank 16. In state 4, he crossflush valve 32 is opened, to drain some more ink out of the drop generator 34, for about 0.5 seconds.

The flush fluid pump 24 is turned on to pump from the Flush fluid tank 20, through the filter 26 and up to the printhead 28 in state 5. The Flush fluid valve 30 is also opened in state 5, to allow the flush fluid to flow through the drop generator 34. The flush fluid servos has a target pressure of 0.5 psi in this state. The initial flow of flush fluid into the drop generator 34 forces the ink in the drop generator and the outlet line 72 through the open crossflush valve 46 and diverter valve 38 into the ink tank 16. In state 6, the waste valve 36 opens allowing fluid to begin flowing also to the waste tank 18.

The diverter valve 38 is closed in state 7, so that all the used flush fluid is directed into the waste tank 18. This crossflush state continues for a predetermined period of time, for example about thirty seconds. With a target pressure at the drop generator for the flush fluid of 0.5 psi, the flush fluid has been weeping out of the orifices in the orifice plate of attached to the drop generator 34. This fluid weeping out of the orifices serves to redissolve ink that may have dried on the exterior of the orifice plate, the face of the charge plate, and catcher face. It also serves to redissolve ink on the eyelid. Failure to clean the ink off the eyelid could leave excessive ink at the eyelid seal that can dry, and possibly prevent the eyelid from opening at the next startup. This ink flows out of the catcher 44 to the waste tank 18 through the open catcher valve 46 and waste valve 36, as a result of the vacuum on the waste tank 18.

The crossflush valve 32 is closed, and the target pressure for the flush fluid pump is increased to 5 psi in state 8. As the ink pressure is rising to the target pressure, the rapid flow of ink out of the orifices pulls any fluid out of the gap between the orifice plate and the charge plate. This state continues for a predetermined time, for example about 20 seconds. This high volume flow of ink out of the orifice plate in this state serves to flush out the catcher valve 46. Failure to remove ink residues from valves such as the catcher valve 46 and crossflush valve 32 which at shutdown have the ink drained from them can result in the valves being stuck with dried ink at the next startup.

In state 9, the crossflush valve is again opened. The target pressure for the flush fluid pump is set to 0.5 psi. This again serves to flush ink residues out of the drop generator and out of the crossflush valve 32. The flush fluid weeping from the orifices again serves to rinse away ink residue from the charge plate and catcher. This state continues for about thirty seconds. In state 10, the vacuum level in the waste tank is increased. The flow of fluid through the printhead remains the same.

In state 11, the flush fluid valve 30 and the crossflush valve 32 are closed. The flush fluid pump is also turned off. With the catcher line open, this state causes air to be draw into the catcher line. This blows the remaining fluid out of the catcher line. This state lasts for a longer time period, for example about sixty seconds.

The crossflush valve 32, waste valve 36, and the air ingest valve 66 are opened and the catcher line closed in state 12. During this state, air is drawn in through filter 74 and the open air ingest valve 66 as a result of the vacuum on the outlet line 72. This serves to evacuate the flush fluid from the drop generator and outlet lines. The air and the entrained flush fluid are directed into the waste tank 16. This state typically lasts about twice as long as the previous state, or about one hundred twenty seconds.

State 13 again involves a weeping crossflush of the drop generator 34. The air ingest valve 66 is closed, the fluid valve 64 and the crossflush valve 32 are open. The flush fluid pump 24 is energized and servo controlled to maintain a 0.5 psi pressure at the drop generator. This state lasts for a shorter time period, for example about thirty seconds.

In state 14, the flush fluid pump 24 is again turned off and the flush fluid valve closed. The crossflush valve 32 and the air ingest valve 66 are open to again evacuate the flush fluid from the drop generator and outlet lines. The catcher valve 46 is also open to concurrently evacuate the catcher line. This state lasts for a predetermined time period, for example about sixty seconds.

The catcher valve 46 is closed in state 15, while the other valves do not change. By closing the catcher valve, the vacuum in the waste tank can increase to enhance the evacuation of liquid from the drop generator 34 and the outlet line 72 of the drop generator. This state continues for a longer time period, typically about one hundred twenty seconds. This evacuation of the drop generator continues through state 20. During this time, the crossflush valve is closed momentarily in states 17 and 19. The momentary closings of the outlet valve serve to pulse the airflow though the valve and the outlet line.

In state 20, the air ingest valve 66, and the crossflush valve 32 are closed and the catcher valve 46 opened. This facilitates further evacuation of the catcher and the catcher return line 76 for a predetermined time period of about sixty seconds. Finally, everything is turned off in state 21, with all the valves de-energized, and the shutdown sequence is complete. The shutdown sequence described here produces a clean, dry printhead that can be started reliably even after extended periods of shutdown. As this shutdown sequence evacuates the printhead, the printhead can be moved or removed from the fluid system without the risk of flammable fluid leaking out of the printhead.

In the fluid system shown in FIG. 1, the ink level sensor, not shown, in the ink tank 16 is used to determine the level of ink in the tank. The ink concentration is monitored by a concentration sensor 80. Concentration control means, not shown, monitors the output of both the ink level sensor and the concentration sensor 80 to determine when to added additional ink or replenishment fluid to the ink tank. Ink is added to the ink tank from ink supply 78 via ink fill valve 82. Replenishment fluid is added to the ink tank from replenishment fluid supply 84 by way of replenishment fill valve 86.

In a solvent based printer, the replenishment fluid can be effectively used as a flush fluid. Therefore, the flush fluid tank 20 can also be refilled from the same replenishment fluid supply 84 that is used to replenish the ink. Flush fluid fill valve 88 controls the filling of the replenishment fluid into the flush fluid tank 20.

In accordance with the present invention, the used flush fluid is directed into a waste tank 18. In aqueous printers, where the flush fluid is much different from the replenishment fluid, it is mandatory that the used flush fluid be directed into a waste tank as was done in U.S. Pat. No. 6,273,103, to prevent contaminating the ink with the flush fluid. In a solvent printer, where the flush fluid is identical to the replenishment fluid, on the other hand it has been common to direct the used flush fluid into the ink tank. Directing the used flush fluid into the ink tank has the undesirable effect of diluting the ink in the ink tank. This problem is overcome by the present invention where the used flush fluid is directed into a waste tank.

Repeated flushing shutdowns can over time result in the waste tank 18 becoming full. The fluid system of FIG. 1 provides a pump 90 to pump the used flush fluid out of the waste tank through waste port 92 into an appropriate chemical waste container.

Figure 3:
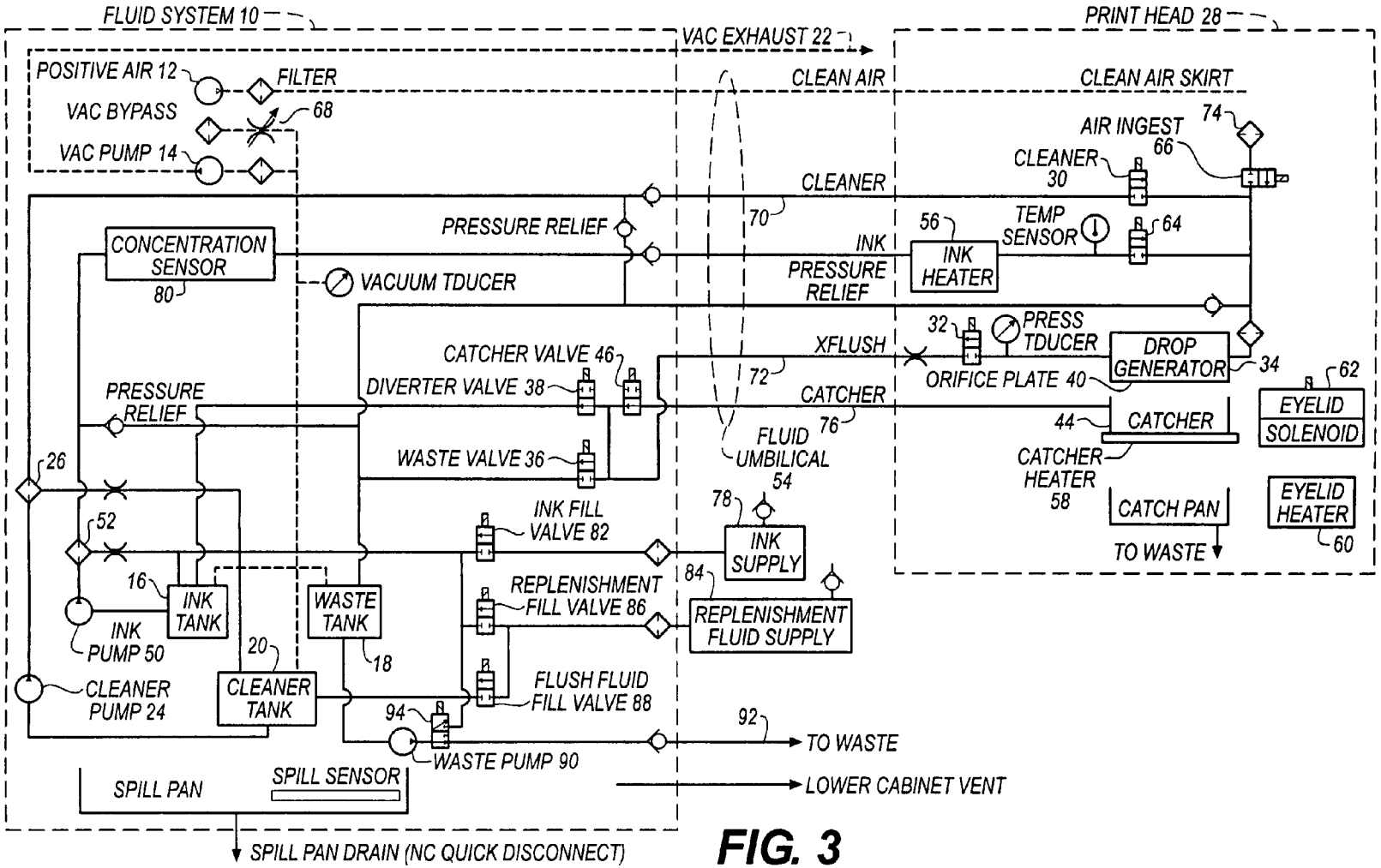
FIG. 3 is a block diagram illustration of an alternative embodiment of a fluid system to which the shutdown procedure of the present invention can be applied.

FIG. 3 is a schematic for an alternate embodiment fluid system. The shutdown sequence employed with this schematic is the same as that using the FIG. 1 embodiment. Recognizing that the used flush fluid that went into the waste tank is just replenishment fluid with some ink mixed into it, this embodiment uses the fluid in the waste tank as replenishment fluid. When the concentration control system calls for supplying the ink tank 16 with replenishment fluid, the waste pump 90 can be turned on, and the waste transfer valve 94 energized to pump fluid from the waste tank 18 into the ink tank 16. Replenishment valve 86 would be kept closed. The waste tank includes level sensing means that can identify a waste tank full condition and a waste tank empty condition. If a waste tank empty condition is sensed, waste pump 90 is turned off, and waste transfer valve de-energized, stopping any further transfer of fluid from the waste tank. If further replenishment fluid is needed to replenish the ink in the ink tank, replenishment valve 86 is opened to transfer fluid from the replenishment supply 84.

If the level sensor in the waste tank 18 senses a waste tank full condition, the waste pump 90 is turned on with the waste transfer valve 94 de-energized to pump fluid out of the waste tank through waste port 92 into an appropriate chemical waste container.

By using the used flush fluid as a replenishment fluid, the embodiment shown in FIG. 3 is able to minimize costs associated with the purchase of replenishment fluids and the disposal of chemical wastes. While the use of the used flush fluid as an ink replenishment fluid has been described in regard to flushing of the printhead during a shutdown sequence, it must be recognized that the used flush fluid might also have been produced during a startup sequence flushing of the printhead as well.

Having described the invention in detail and by reference to the preferred embodiment thereof, it will be apparent that other modifications and variations are possible without departing from the scope of the invention defined in the appended claims.

The invention claimed is:

1. A method for shutting down a continuous inkjet printer having a printhead with an associated droplet generator and orifice plate, the method comprising:

providing a flush fluid;

providing a line and a valve operatively associated with the line to supply the flush fluid directly to the printhead;

crossflushing the flush fluid through the drop generator to clean an interior of the drop generator; and causing the flush fluid to weep out of orifices in the orifice plate of the drop generator to dissolve and rinse away residue from a charge plate associated with the drop generator, a catcher face, and a catcher return line, wherein providing the flush fluid includes providing a replenishment fluid from a replenishment supply to use the replenishment fluid as the flush fluid.

2. The method of claim 1, wherein the step of causing the flush fluid to weep out of drop generator orifices further comprises the step of causing the flush fluid to rinse ink off an eyelid associated with the printhead.

3. An automatic shutdown system for shutting down a continuous inkjet printer having a printhead with an associated droplet generator and orifice plate comprising:

means for providing a replenishment fluid from a replenishment supply to use the replenishment fluid as a flush fluid;

a line and associated valve at the printhead to supply the flush fluid directly to the printhead;

means for crossflushing the flush fluid through the drop generator to clean an interior of the drop generator; and means for causing the flush fluid to weep out of orifices in the orifice plate of the drop generator to dissolve and rinse away residue from a charge plate associated with the drop generator, a catcher face, and a catcher return line.

4. The system of claim 3, wherein the means for causing the flush fluid to weep out of drop generator orifices comprises means for causing the flush fluid to rinse ink off an eyelid associated with the printhead.

* * * * *